US005949026A

United States Patent [19]

DeFlorio

[11] Patent Number: 5,949,026

[45] Date of Patent: Sep. 7, 1999

[54] TANGLE-RESISTANT ELECTRICAL TEST LEADS

[76] Inventor: Ralph E DeFlorio, 202 Water St., Hillsboro, Ind. 47949

[21] Appl. No.: 08/980,601

[22] Filed: Dec. 1, 1997

[51] Int. Cl.[6] ..... H01B 7/00

[52] U.S. Cl. ..... 174/117 R

[58] Field of Search ..... 174/112, 113 R, 174/114 R, 114 S, 74 R, 36, 135, 136, 138 F; 24/381, 403

[56] References Cited

U.S. PATENT DOCUMENTS

| | | | |
|---|---|---|---|
| 2,585,054 | 2/1952 | Stachura | 174/36 |
| 4,684,762 | 8/1987 | Gladfelter | 174/36 |
| 5,391,838 | 2/1995 | Plummer, III | 174/36 |

*Primary Examiner*—Kristine Kincaid
*Assistant Examiner*—William H Mayo, III

[57] ABSTRACT

A pair of tangle resistant electrical test leads, the pair having a first and a second conductor attached to a nonconductive slide fastener, such as a nylon zipper. The first and second conductors are surrounded by loop and hook material. The loop material is attached to the upper side of a first border of the zipper and the hook material is attached to the under side of the second border of the zipper. In a zipped state, the leads remain parallel and of uniform separation, thus eliminating entanglement of the individual leads. When the zipped leads are wrapped about a meter or other test instruments, the loop and hook material secures the wrapped leads upon themselves, in a half-lapped wrapping, thus preventing entanglement of the joined leads. During usage of the electrical test leads, when their full length is not required, the tangle electrical test leads can be unwrapped and unzipped only as much as needed, thereby keeping the leads neater and reducing the likelihood of entanglement.

2 Claims, 3 Drawing Sheets

FIG. 3
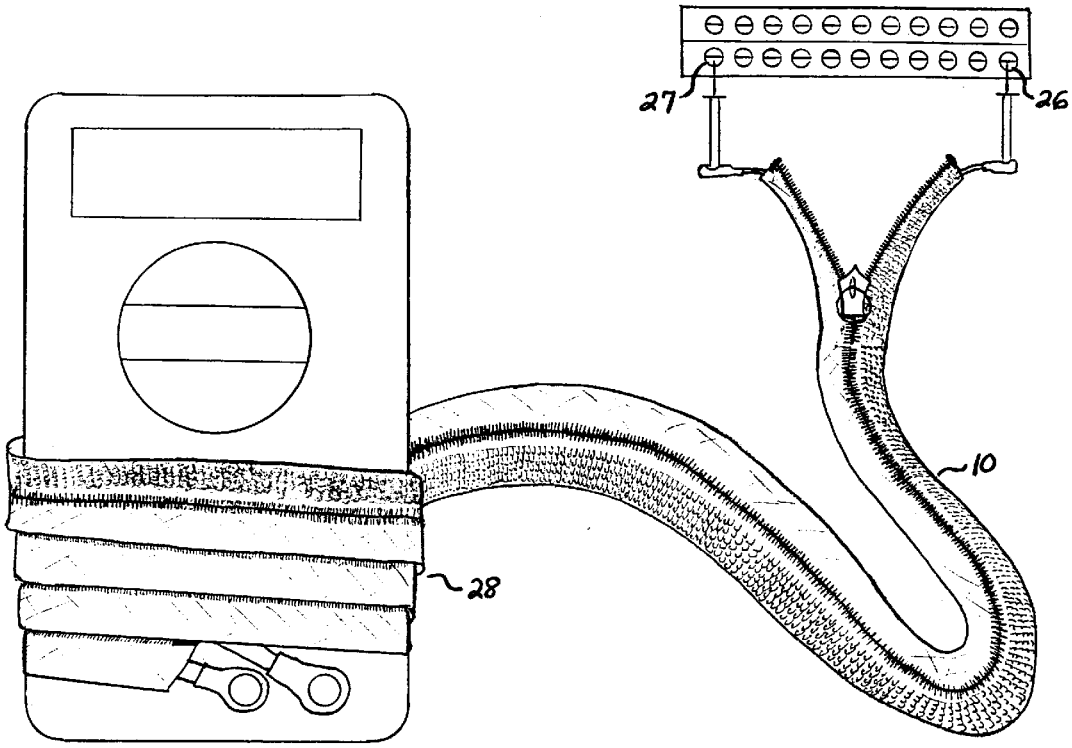
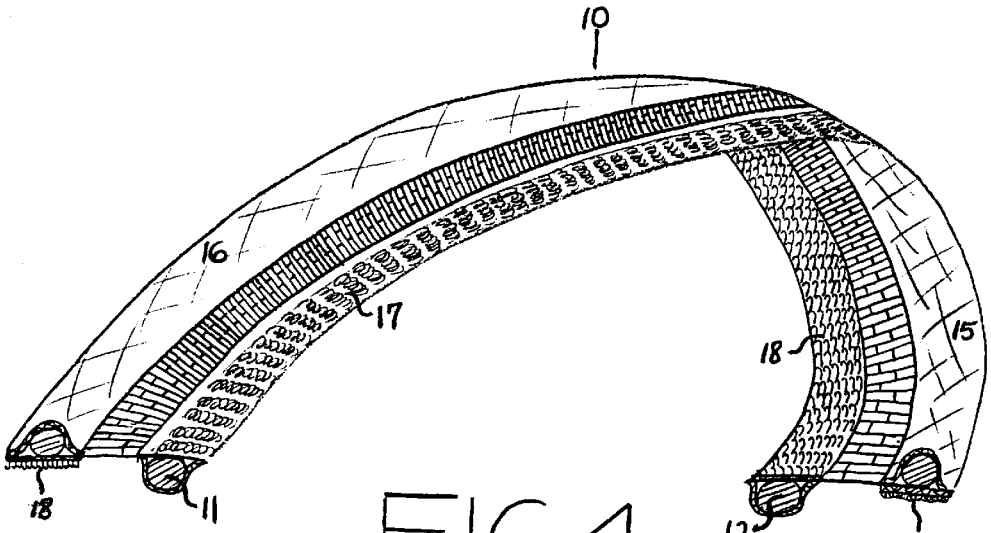
FIG. 4

TANGLE-RESISTANT ELECTRICAL TEST LEADS

CROSS-REFERENCE TO RELATED APPLICATIONS

Classification: 174/DIG11; U.S. Pat. No. 5,391,838

Classification: 24/381+; U.S. Pat. Nos. 5,067,207 and 4,922,584

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to a set of test leads which carry electrical signals from test points in an electrical circuit to a measurement instrument such as a volt-ohm meter or VOM.

Test leads often occur in pairs. One, typically red in color, the other, typically black in color. The red lead being usually connected to the signal to be measured, while the black lead is usually connected to ground or other voltage reference point. Meter lead pairs often tangle and knot necessitating time consuming untangling of the leads. Furthermore, with the advent of modern, flexible test leads, which have increased in length to five feet or longer, tangling of these test leads has become more of a problem.

Prior art has failed to solve this annoying problem. Although there have been zippered jackets or sheaths, that encase wire bundle assemblies, they do not keep the meter leads parallel to each other and at a uniform separation; therefore, these jackets still permit possible tangling to occur within the jacket. Furthermore, these sheaths pose an added disadvantage of getting in the way when unzippered; that is, they themselves become an extraneous item to further clutter the work place, thus sheaths are best suited to long-term cable management or storage rather than useable, tangle-resistant leads for test instruments.

Dyeable colored zippers are also prior art, but not in the sense used in this invention. In this invention the zippers, as well as the hook-and loop fastened to the zipper boarders, are color dyed to match the red test lead and black test lead to aid in identification. Moreover, each half of the zipper set is permanently attached to its corresponding meter lead and, when unzipped, stays with its corresponding lead, thus not adding another loose end.

BRIEF SUMMARY OF THE INVENTION

This invention makes intertangling of the individual test leads impossible when in the zippered or stored state. Also, the alternate loop-and-hook arrangement, attaching the signal leads to the upper and under side of alternate zipper boarders, helps prevent entanglement of the two leads as a combined entity.

The tangle-resistant leads comprise a set of test leads, each encased to a border half of the zipper. The leads are encased, one by a layer of loop material sewed or glued to one of the zipper border halves; the other lead being encased by a layer of hook material sewed or glued to the other zipper border half, on the opposite side. When zipped, the leads are parallel and keep a uniform distance of separation, thereby eliminating individual entangling. When the zipped unit is wrapped around the meter for storage, the hooks of the underside engage the loops of the opposite, upper side, of the previous wrap when using a half-lapping wrap for storage. This prevents entangling of the zippered unit and also allows for partial unwrapping when only a small length of test leads is needed.

When maximum lead lengths are needed, the leads can be unzippered to the point of complete separation, thus effecting no loss of the usable meter lead lengths. When less than maximum lead lengths are needed, the leads can be unzipped only as much as needed.

BRIEF DESCRIPTION OF THE SEVERAL VIEWS OF THE DRAWING

FIG. 3 is a perspective view of the tangle-resistant electrical test leads of the invention used to sample an electrical signal from test points and to convey that signal to a meter. The leads are shown partially unzippered and partially unwrapped from a half-lap wrapping.

FIG. 4 is an enlarged sectional view of a section of length of the joined electrical test leads, detailing the alternate loop-and-hook pattern.

DETAILED DESCRIPTION OF THE INVENTION

Figure 1:
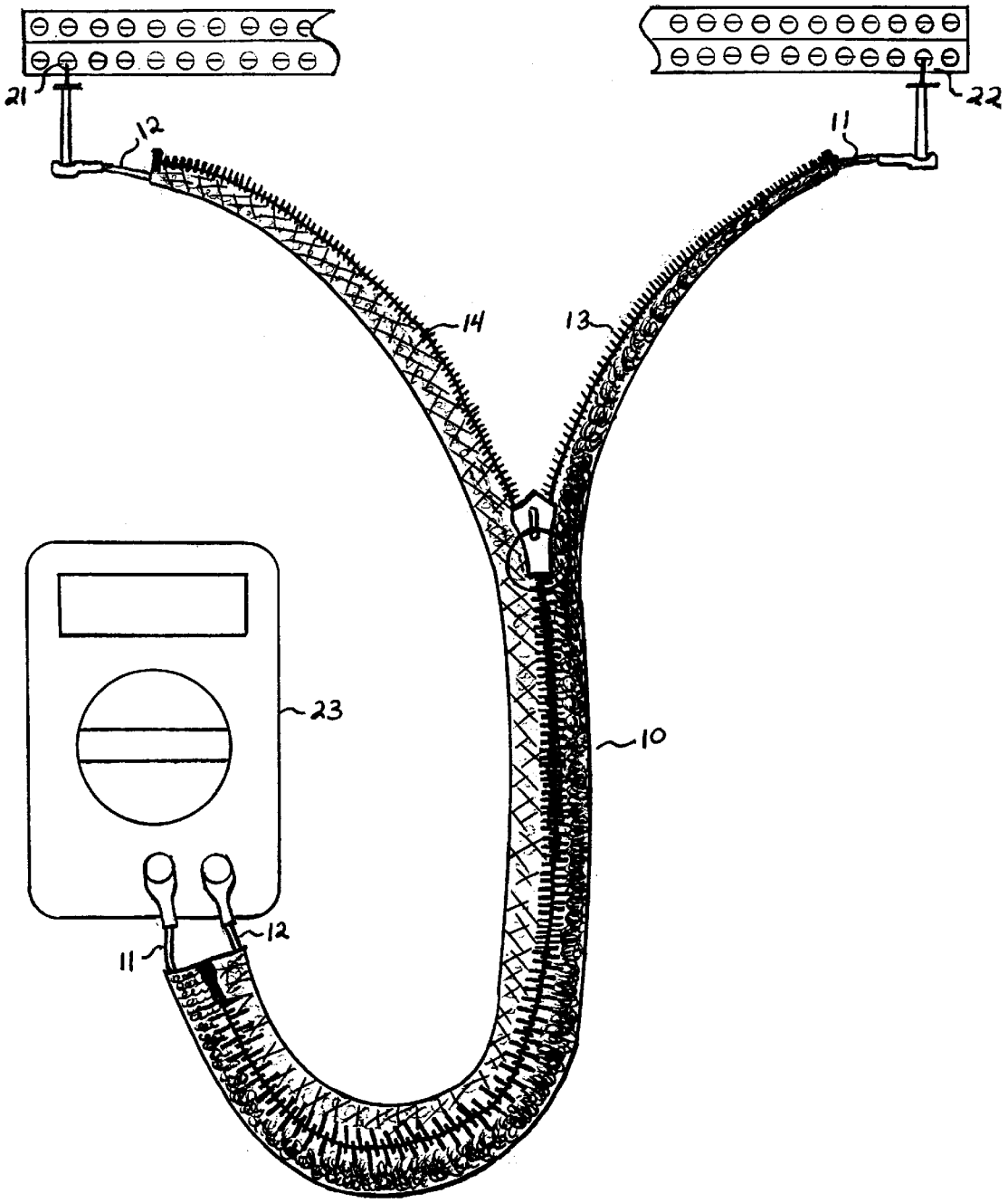
FIG. 1 is a perspective view of the tangle-resistant electrical test leads of the invention used to sample an electrical signal from test points and convey that signal to a meter. The leads are shown partially unzippered and fully unwrapped.

Referring to FIG. 1, a set of tangle-resistant electrical test leads, indicated generally at 10, comprising insulated electrical conductors 11 and 12 attached along and to each half of a non-electrically conductive zipper 13 and 14.

The tangle-resistant electrical test leads 10, as shown in FIG. 1 are operable to be partially unzippered and fully unwrapped as to facilitate the taking of electrical signals from test points 21 and 22, which are a moderate distance apart, and conveying those signals to a meter 23.

Figure 2:
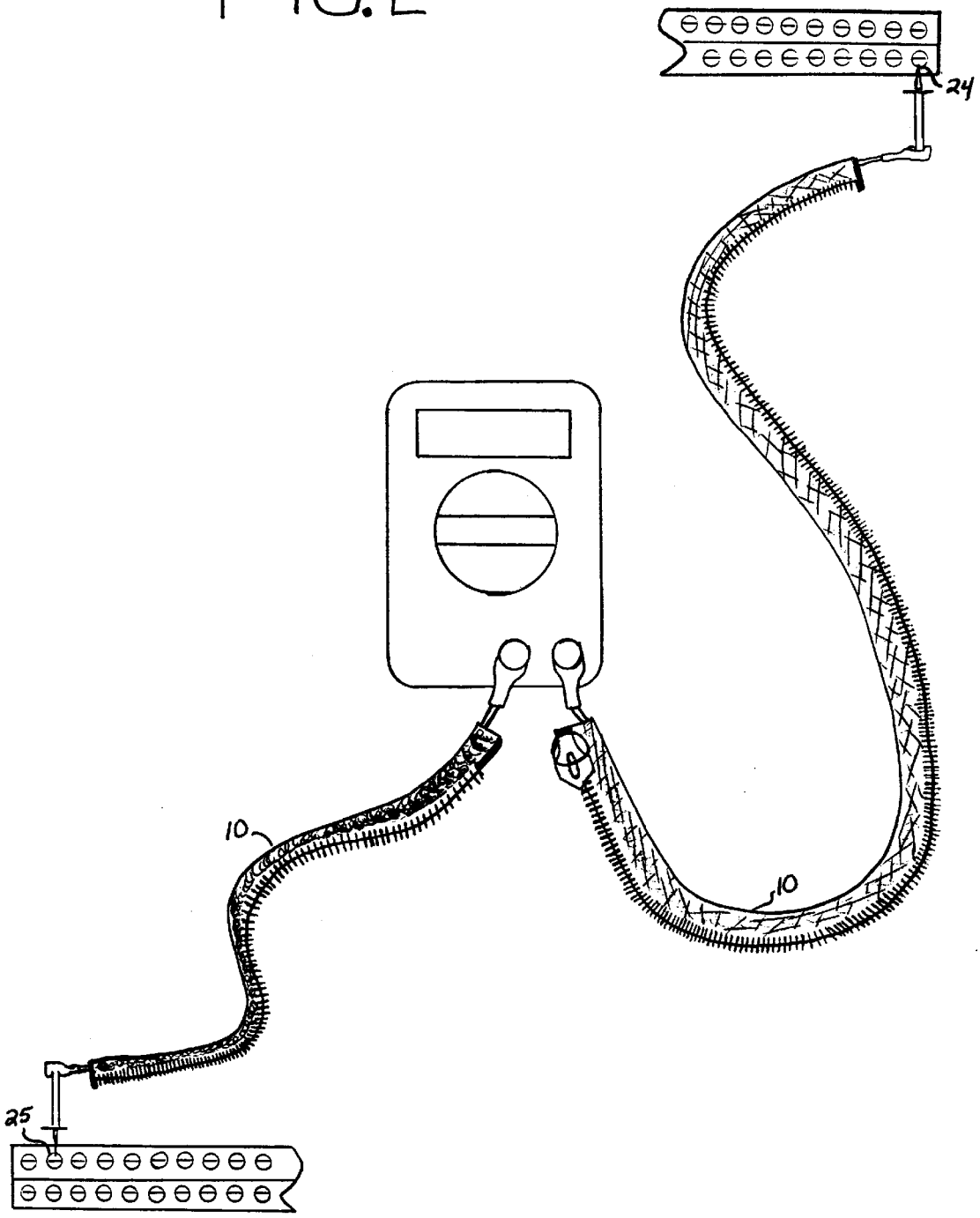
FIG. 2 is a perspective view of the tangle-resistant electrical test leads of the invention used to sample an electrical signal from test points and to convey that signal to a meter. The leads are shown fully unzippered and fully unwrapped.

The tangle-resistant electrical test leads 10, as shown in FIG. 2 are operable to be totally unzippered and fully unwrapped as to facilitate the taking of electrical signals from test points 24 and 25, which are a large distance apart and require full usable length of test leads 10.

The tangle-resistant electrical test leads 10, as shown in FIG. 3 are operable to be partially unzippered and partially unwrapped as to facilitate the taking of electrical signals from test points 26 and 27, which are a small distance apart, and require only a partial unwrapping from the half-lapped wrap 28.

FIG. 4 illustrates a section of the tangle-resistant electrical test leads 10, wherein insulated electrical conductor 11 is attached to zipper first border 15 by loop material 17 being secured with sewing or glue to first border 15. Insulated electrical conductor 12 is attached to zipper second border 16 by hook material 18 being secured with sewing or glue to second border 16.

While there has been shown and described a preferred embodiment of the tangle-resistant electrical test leads of this invention, it is understood that changes in materials, sizes, shapes and colors can be made by those skilled in the art without departing from the invention; although the invention is demonstrated in its simplest form of two electrical test leads, it is understood that more than two leads could be incorporated by multiple applications of this invention. The invention is defined in the following claims.

I claim:

1. A pair of tangle resistant electrical test leads comprising:

first and second flexible electrically insulated conductors wherein the first conductor is attached to and along a length of a first border of a non metallic and nonelectrically conductive slide fastener; said second conductor is attached to and along a length of a second border of said slide fastener; wherein each said border is constructed of a cloth or non-metallic and non electrically conductive flexible material; said slide fastener having an operable means for separating said slide fastener into two halves wherein said means separates said first and second conductors as much as needed to reach electrical test points and obtain electrical signals; said operable means also rejoins said first and second conductors to prevent entanglement of said first and second conductors; said first and second conductors being sewed, glued, or molded to their respective said first and second borders of the slide fastener to remain attached to their respective said first and second borders during separation and rejoining of the slide fastener by said operable means.

2. A pair of tangle resistant electrical test leads of claim 1 wherein:

a non metallic and non electrically conductive loop material covers a first face of said first border of said slide fastener; said loop material being sewed, glued, or molded to said first face of said first border;

a non metallic and non electrically conductive hook material which covers a second face of said second border of said slide fastener; said hook material being sewed, glued, or molded to said second face of said second border; said loop material and said hook material being located on opposite and alternate sides of said slide fastener, said loop material and said hook material having an additional operable means for securing said test leads in a rejoined state upon themselves when wrapped about a test instrument in a half-overlapped wrapping manner.

* * * * *